United States Patent [19]

Christie et al.

[11] Patent Number: 5,050,827

[45] Date of Patent: Sep. 24, 1991

[54] FLOOR SUPPORT FOR CLARINET, SOPRANO SAXOPHONE, OBOE AND ENGLISH HORN

[76] Inventors: James Christie, 1930 W. San Marcos Blvd. #274, San Marcos, Calif. 92069; Robert Shelton, 2318 Starlight Dr., Anderson, Ind. 46012

[21] Appl. No.: 545,889

[22] Filed: Jun. 29, 1990

[51] Int. Cl.[5] ..... A47G 29/00

[52] U.S. Cl. ..... 248/125; 248/167

[58] Field of Search ..... 248/125, 176, 165, 158, 248/122, 121, 161, 411, 413, 167, 166, 188.7; 84/327

[56] References Cited

U.S. PATENT DOCUMENTS

| | | | |
|---|---|---|---|
| 706,176 | 8/1902 | Hassett | 248/122 |
| 1,541,767 | 6/1925 | Mortensen | 248/122 |
| 1,609,242 | 11/1926 | Dewey | 248/167 |
| 1,773,237 | 8/1930 | Naujoks | 248/167 |
| 2,153,821 | 4/1939 | Walberg | 248/121 |
| 2,464,031 | 3/1949 | Fiedel | 248/167 |
| 2,522,345 | 9/1950 | Cashiopp | 248/121 |
| 2,552,921 | 5/1951 | Anderson | 248/167 |
| 2,920,851 | 1/1960 | Carlini | 248/171 |
| 2,975,599 | 3/1961 | Bunch | 248/121 |
| 3,266,766 | 8/1966 | Linville | 248/359 |
| 3,357,666 | 12/1967 | Smith et al. | 248/125 |
| 4,841,829 | 6/1989 | Lehman | 84/385 A |

FOREIGN PATENT DOCUMENTS

| | | | |
|---|---|---|---|
| 441287 | 12/1925 | Fed. Rep. of Germany | 248/167 |

*Primary Examiner*—J. Franklin Foss

[57] ABSTRACT

A support for the total weight of an instrument while playing in both sitting and standing positions having a base with foldable support arms, a height adjustable vertical tube and rod combination mounted in base's center. Two lengths of vertical tubes provide sitting and standing capability. Rod is bent at its top and attaches at right angle to a Y shaped instrument mount, a post equidistant to the inner sides of mount and in mount's center rests instrument's bell thereby securely supporting all instrument weight without attachments or insertions into instrument.

11 Claims, 1 Drawing Sheet

FLOOR SUPPORT FOR CLARINET, SOPRANO SAXOPHONE, OBOE AND ENGLISH HORN

BACKGROUND—FIELD OF INVENTION

This invention relates to a support stand for supporting the weight of a clarinet, soprano saxophone, oboe or English horn while playing in both sitting and standing positions.

BACKGROUND—DESCRIPTION OF PRIOR ART

These instruments require the player to hold the instrument on the right thumb these instruments weighs approximately two pounds. This causes discomfort. The weight of the instrument, because of muscle tension, impedes finger dexterity. The length of practice sessions is shortened because the thumb must be rested. Young players have difficulty supporting the instrument, and form bad habits. This impedes the student's progress on the instrument.

Some inventors have atempted to solve the problem of weight. U.S. Pat. No. 4,481,829 to Lehman (1989) is a device for supporting the weight of the clarinet. This device has a band which fastens around the right wrist. A strap attaches to the wristband which goes between the thumb and forefinger, extends to the body of the clarinet, and is attached. The weight is redistributed to the thumb and forefinger. This will leave some discomfort and restrictions for optimum finger dexterity. The life expectancy of a strap device is limited.

A floor standing support, U.S. Pat. No. 3,357,666 to Smith and Ehrlich (1967). This invention supports the clarinet with two hollow rings of different diameters attached to a rod. They are inserted into the bell of the clarinet. The angle of the holder determines the angle by which the player must play. This may not be correct for the player. Any insertion into the clarinet will cause pitch problems. Tonal quality is affected. The support can only be used in a sitting position.

SUMMARY OF THE INVENTION

The principal object of this invention is to provide a simple portable support stand which is easily adjustable to hold all of the weight normally on the right thumb of the player, resulting in better finger dexterity. Another object is to provide a support stand which requires no attachments to or insertions into the instrument thereby causing no alterations in pitch or deterioration of tone quality. A further object is to construct a stand which by placement at the correct distance in front of the player will determine the proper angle to the mouth of the player. An additional object is to use the support stand while playing in a standing position. A further object is the stand's adjustability to the proper height for players of all ages and sizes thus allowing freedom of lateral movement.

Further objects and advantages will become apparent from consideration of the description and drawings.

BRIEF DESCRIPTION OF THE DRAWINGS

The following detailed description refers to the accompanying drawings. Like numerals refer to like parts in the drawings if not given separate numbers because of placement.

REFERENCE NUMERALS IN DRAWINGS

Figure 1:
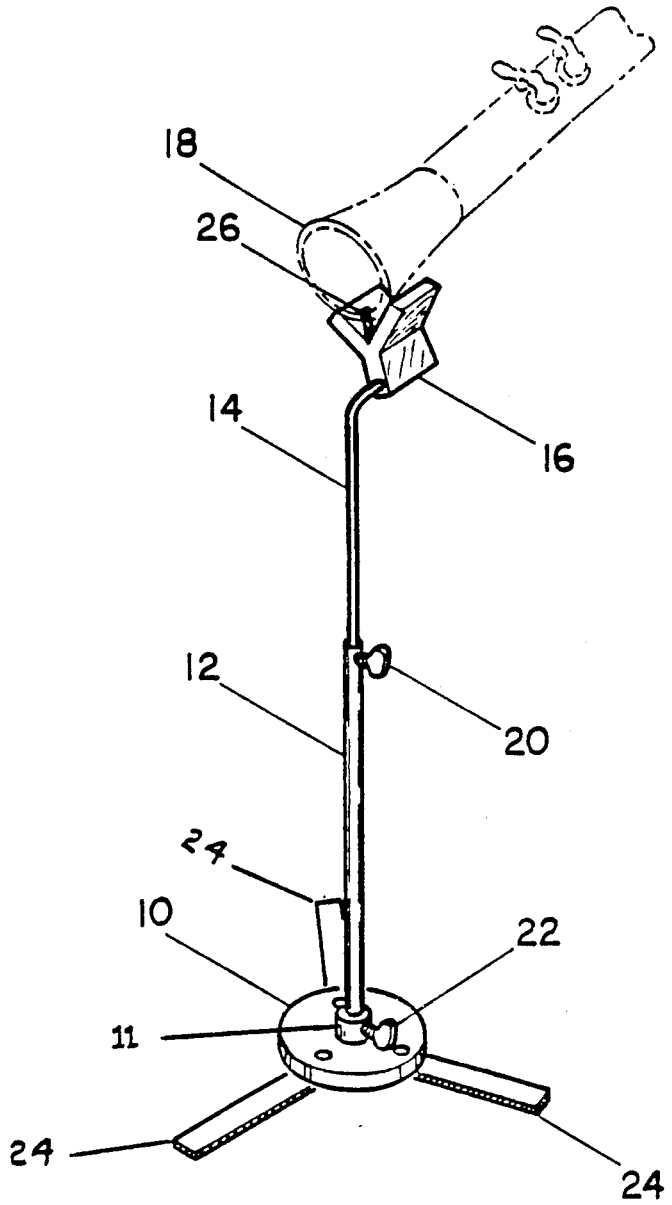
FIG. 1 shows the floor support assembled for standing practice.

10 base support
11 tube insert
12 long vertical tube
13 short vertical tube
14 extension rod
16 musical instrument mount
18 musical instrument
20 set screw for vertical tube (2)
22 set screw for tube insert
24 base arms (3)
26 musical instrument stop

DESCRIPTION OF PREFERRED EMBODIMENTS

Figure 2:
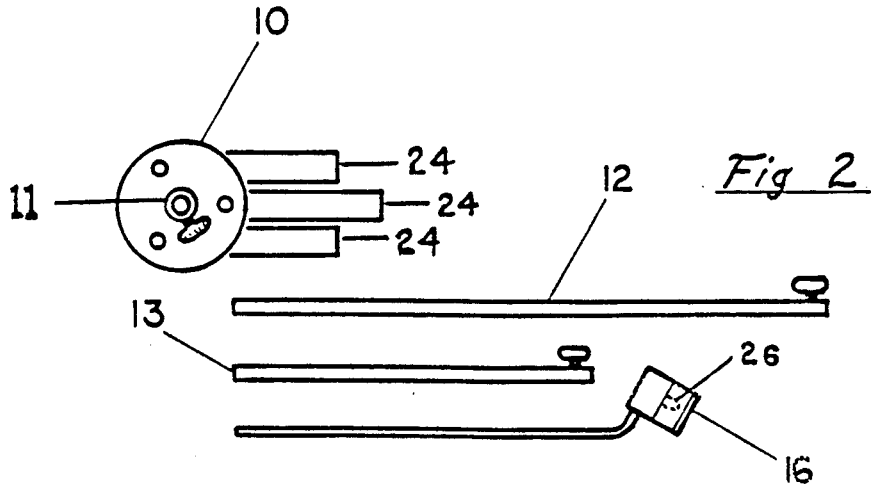
FIG. 2 shows the floor support disassembled. It also includes the shorter Tube 13, to be used for sitting practice by musicians.

An embodiment of the present invention is illustrated in FIG. 1. The support has a small base 10 of circular (or other suitable shape) metal having a tube insert 11 attached to its center and a set screw 22 (or other tightening device) for tightening vertical tube 12 or vertical tube 13. Base 10 has arms 24 (3) attached under it with bolts, pins, rivets (or other suitable holders). Arms 24 (3) are to be foldable as shown in FIG. 2. Arms 24 (3) when properly positioned form a Y shape when viewed from the front. The vertical tube 12 or 13 inserts into tube insert 11 aperture and is tightened by set screw 22. The extension rod 14 is inserted into the bore of tube 12 or 13 and is secured by set screw 20 (or other tightening device). Extension rod 14 is bent near its top at approximately a thirty degree angle. The musical instrument mount 16 is in the shape of a Y (or other suitable shape) and is attahced flush at right angle to bent end of extention rod 14 by screw, pin, weld (or other suitable means). Musical instrument mount 16 must from two to three inches wide at the top of Y shape to accommodate any of the musical instruments. Musical instrument stop 26 is attached to musical instrument mount 16 in the center of Y shape equidistant from the sides of Y and toward the rod end of 16 at approximately a thirty degree angle.

FIG. 2 shows base 10 and arm 24 (3) folded for portability. The long vertical tube 12, the short vertical tube 13 and the extension rod 14 attached to the musical instrument mount 26 are shown individually. FIG. 2 shows clearly the simplicity and portability of this invention.

From the description above a number of advantages of the floor support for clarinet, soprano saxophone, oboe, and English horn become evident: no alteration in pitch or tonal quality will result from using the stand, the stand requires no attachments, insertions, or alterations to the instrument played, height of playing and angle of playing will be correct for the player, both standing and sitting performance usage is possible, and the floor support will remove all of the weight from the player's right thumb.

To assemble the floor support for clarinet, soprano saxophone, oboe and English horn begin by unfolding base arms 24 (3), attached to base 10, to Y shaped configuration shown in FIG. 1. Next insert either long vertical tube for standing 12 or short vertical tube for sitting 13 into the aperture in center tube insert 11 and tighten set screw 22. Extension rod 14 attached to musical instrument mount 16 is inserted into bore of either tube 12 or 13 and set screw 20 is tightened when extension rod 14 is at the right height. The instrument—either clarinet, sporano saxophone, oboe or English horn is placed on musical instrument mount 16 and floor support is moved toward or away from the player for correct playing angle.

To disassemble the floor support for clarinet, sporano saxophone, oboe and English horn loosen set screw 20 and remove the extension rod 14 attached to musical instrument mount 16. Next loosen set screw 22 and remove either long vertical tube for standing 12 or short vertical tube for sitting 13. Finally, fold base arms 24 (3) together. The result of disassembly is shown in FIG. 2.

The above operational description clearly shows the simplicity and utilitarian value this floor support stand has for clarinet, sporano saxophone, oboe and English horn players.

Accordingly, this invention can support the entire weight of the instrument. The support can be used for both sitting and standing performance. Young players can properly place their right hands. Discomfort from support weight on right thumb is gone. Elimination of muscle tension from weight of instrument improves dexterity. Tonal qualities and intonation are not affected. No attachments to, insertions into, or alteration of instrument is required. Proper height and angle of playing is allowed. Assembly and disassembly are quick and easy.

Though many specificities are recited above, these should not be construed as limiting the scope of the invention, but rather as an exemplification thereof. Many other variations are possible.

The shape and size of the base 10 may change. It may necessitate arms 24 (3) fold upward from base 10, rather than parallel as in FIG. 2. A variety of vertical tube lengths 12 and 13 to accomodate extreme height variations of various instrumentalists. A differently shaped musical instrument mount 16. Redesign or elimination of the musical instrument stop 26.

All of these possibilities and others may yet be conceived. Uses for the floor support outside of the field of musical instruments may also be conceived and should not be excluded from the coverage of this patent application.

We claim:

1. A support stand for the instruments described comprising a base having foldable support arms into side by side relationship, an insert in center of said base, a vertical tube and rod inserted in said tube are adjustable in length removeably mounted in said insert, means for determining different sitting positions the height of said support stand, said tube is approximately 11 inches long, said rod is about 11 inches long and bent near a thirty degree angle from said rod's vertical end, means for receiving a mount and a stop means for resting said instrument's weight, and mount being Y shaped and attached to bent end of said rod at right angle to said rod's center, said stop is attached to center equidistant from inner sides of said mount, said stop is approximately one inch long providing means for resting the bell of said instruments securely without lateral movement restrictons, whereby all of said instrument's weight is on said stop.

2. The vertical tube of claim 1 is approximately 22 inches long whereby allowing usage while standing.

3. The vertical tube and rod inserted in said tube of claim 1 which provides a means for telescoping and locking to correct height.

4. The support stand of claim 1 comprises means for placement on floor whereby establishing the correct angle to mouth of player.

5. The support stand of claim 1 wherein body is constructed of steel.

6. The support stand of claim 1 wherein body is made of aluminum.

7. A support stand for the instruments described comprising a base without support arms, means to fold into side by side relationship, an insert in center of said base, a vertical tube in said insert, a rod removeably mounted in said tube said rod constituting means for sliding in said tube for correct height adjustment in sitting playing position of said support stand, said tube is approximately 11 inches long bent near a third degree angle from said rod's uppermost end, an instrument mount attaches at center to said rod's uppermost end at right angle, said mount is Y shaped, an instrument stop attaches to center equidistant from inner side of said mount, said stop is approximately one inch long providing means for resting bell of said instrument whereby all weight is resting on said stop without the restrictions imposed by bands, clamp, insertions into or other such devices.

8. The vertical tube of claim 7 is approximately 22 inches long whereby allowing usage while standing.

9. The support stand of claim 7 comprises means for placement on floor whereby establishing the correct angle to mouth of player.

10. The support stand of claim 7 is constructed of steel.

11. The support stand of claim 7 is constructed of aluminum.

* * * * *